US006167941B1

(12) United States Patent
Schallenberg

(10) Patent No.: US 6,167,941 B1
(45) Date of Patent: Jan. 2, 2001

(54) SUPPORT STRUCTURE FOR OSCILLATING CONTINUOUS CASTING MOLD

(75) Inventor: Stephan Schallenberg, Düsseldorf (DE)

(73) Assignee: SMS Schloemann-Siemag AG, Dusseldorf (DE)

( * ) Notice: Under 35 U.S.C. 154(b), the term of this patent shall be extended for 0 days.

(21) Appl. No.: 09/205,499

(22) Filed: Dec. 4, 1998

(30) Foreign Application Priority Data

Dec. 6, 1997 (DE) ..... 197 54 274

(51) Int. Cl.[7] ..... B22D 11/053
(52) U.S. Cl. ..... 164/416; 164/478
(58) Field of Search ..... 164/416, 200, 164/478, 71.1; 425/425

(56) References Cited

U.S. PATENT DOCUMENTS 3,664,409 * 5/1972 Kolomeitsev et al. ..... 164/260
4,593,743 * 6/1986 McVay et al. ..... 164/416
5,769,148 * 6/1998 Kaiser et al. ..... 164/416

FOREIGN PATENT DOCUMENTS 2 248 066 4/1974 (DE) .
43 41 719 4/1995 (DE) ..... B22D 11/04
0 150 357 8/1985 (EP) .
0 421 560 4/1991 (EP) .

* cited by examiner

*Primary Examiner*—Kuang Y. Lin
(74) *Attorney, Agent, or Firm*—Herbert Dubno

(57) ABSTRACT

A support structure for an oscillating continuous casting mold has fixed vertical support beams and oscillating frames attached to the fixed support beams by links with rigid intermediate portions connected by leaf spring hinges to the beams and the support frames.

9 Claims, 2 Drawing Sheets

SUPPORT STRUCTURE FOR OSCILLATING CONTINUOUS CASTING MOLD

FIELD OF THE INVENTION

My present invention relates to a support structure for an oscillating continuous casting mold and, more particularly, to a support structure upon which the continuous casting mold assembly can be mounted and which has a part supporting the continuous casting mold assembly and another part which is fixed.

BACKGROUND OF THE INVENTION

A continuous casting mold assembly with its casting mold, generally of copper, is customarily mounted on a support which allows oscillation of the mold during the continuous casting operation. Without such oscillation, movement of the metal strand through the mold is less effective and, in the course of oscillation, care must be taken to ensure that breakthrough of the melt does not occur since such breakthroughs can only be cleared by expensive and time-consuming operations.

The various approaches to oscillation of the mold have included:

Spring-guided Oscillation with Four Eccentric Drivers

Here the oscillating mold is suspended in a fixed frame by means of four leaf springs and is guided by the springs without play. The mold is therefore able to move in the vertical direction and maintenance and wear in this system are limited. It is however a drawback that the mold can only move in its track in the vertical direction. The guidance in all positions of the mold to be effective at all four corners and the oscillating drive has required two eccentric shafts each carrying two eccentrics for the mold. Not only is this a costly and complex drive arrangement, but the entire eccentric drive lacks the versatility which is often desirable.

Short Lever Oscillation with Two Eccentrics

In this system the mold is guided by two parallelogrammatic linkages in the vertical direction. The drive is effected via a lever which has a lower rocker or crank extended beyond the fixed pivot point. The mold is so guided in its vertical upward and downward movement in a track. This system has the drawback that the base of the system must carry twice the load of the mold and the bearing must pick up not only the guiding forces but also the lifting forces.

As a consequence, the bearings must be massive and the capital cost is high and the maintenance and repair costs. The downtime of such systems may be significant and the maintenance efforts substantial.

Parallelogrammatic Oscillation with Two Hydraulic Cylinders

In this arrangement the mold is supported in two parallelogrammatic linkages for vertical movement. The lifting force is applied directly beneath the mold. During the upward and downward movement, the mold must be guided along its track and also have its position established at each point in time. The driving action requires two cylinders. The disadvantage of this arrangement is that the rotation in the respective bearings is only to a limited angular extent and, while eight expensive bearing assemblies are provide and maintained, the limited movement makes nonuniform wear almost inevitable. The bearings must be protected from the cooling water and lubricated by a central lubricating system and balancing to limit bearing play is practically impossible.

Resonance Mold

In this system, the mold is guided at each side by two leaf springs in a frame. The leaf springs support the mold with their resiliency. The mold is suspended in a manner free from play and requires no maintenance-intensive bearing. The guidance of the mold as to path and location is not at all problematical. Here however the springs have a great effect on the nature of the oscillation since the spring constants must be very large in order to support the mold. In the simplest case, a sinusoidal oscillation shape with the frequency of the characteristic resonance of the spring/mass system is observed. A defined guidance of the material is possible only with a very stiff spring. With oscillation frequency changes, numerous drawbacks can ensue, including the development of extensively large and noncontrollable reaction forces which can excessively strain the system.

Spring-Guided Oscillation with Hydraulic Drive

In this case the oscillating mold is mounted upon a mold frame and the frame on each side is guided by two leaf springs in a manner similar to that described previously for the resonance mold. The leaf springs have a low spring constant and hence low stiffness. As a result, the mold must continuously be driven in all positions thereof. For this purpose, the drive uses four hydraulic cylinders which are provided directly below the mold. The mold is maintenance-free and free from play in the vertical direction. The hydraulic drive can give rise to different lifting modes. A drawback of this arrangement is that the mold is guided only as to its path in the vertical direction. The establishment of location depends upon effective control of the oscillating drive at all four corners of the mold and hence four hydraulic cylinders must be used for this purpose. The hydraulic control mandates that the four cylinders be operated absolutely synchronously. The control system required for this purpose is both expensive and large.

EP 0 421 560 A1 describes an oscillating device for a continuous casting mold with a rectangular base frame on which two rotatably driven eccentric wheels are arranged in parallel. The eccentrics impart oscillation to the mold.

To ensure an exact movement of the relatively low mass mold, the mold is fixed in an opening of a support plate and below each corner of the support plate a wear plate is provided. The wear plate rests upon an outer ring of an eccentric which is journaled rotatably on the eccentric. In addition, spring rods are disposed parallel to the edges of the support plate. The labor involved in maintenance and generally the cost of such a mounting arrangement because of the maintenance and wear is comparatively high.

EP 0 150 357 describes a guide arrangement for an oscillating extrusion mold in which a mold lifting table is provided to which the mold is affixed by holders, connected by spring elements with a frame. In their intermediate regions the frame carriers are anchored to the frame and have leaf springs with ends affixed to the frame. The lifting table for the mold is connected via an intermediate member with the leaf springs at the leaf spring centers.

Finally, reference is made to DE-OS 22 48 066 which discloses a further device for guiding an oscillating continuous casting mold. In this device the mold is affixed to spring elements which extend transversely to the oscillation direction and are anchored on a support frame. These spring elements are stressed in one direction as a kind of cantilever beam, whereby the mold is affixed at free ends thereof. The spring elements are multilayer spring stacks so constructed and arranged that the bending under the mold weight corresponds to at least the oscillation stroke of the mold.

OBJECTS OF THE INVENTION

It is the principal object of the present invention to provide an improved support arrangement for a continuous casting mold which extends principles set forth in these earlier systems but at least in part overcomes the drawbacks of them.

More specifically it is an object of the invention to provide an improved system for supporting a mold which guarantees a long operating life by reducing play at pivot points and which represents a low maintenance and low wear construction which can be fabricated at low cost and does not develop intrinsic resonances radially which can result in breakdown.

Still another object of the invention is to provide an improved mounting for a continuous casting mold assembly which permits exceptionally precise guidance of the oscillating mass.

SUMMARY OF THE INVENTION

These objects and others which will become apparent hereinafter are attained, in accordance with the invention, in a support for a continuous casting mold which is intended to oscillate and which may be of the type described in the commonly assigned copending application Ser. No. 09/205,501 (Attorney's docket No. 20936) and based upon German national application 197 53 959.9 filed Dec. 5, 1997 and incorporated herein by reference.

According to the invention the support frame comprises a pair of fixed vertical beams upon which a pair of support frames can be mounted by means of two link assemblies provided one above the other and each of which is comprised of hinge joints with the upward beam and the respective support, each of these hinge joints including a respective leaf spring.

Advantageously, the support frames have cantilevered limbs upon which the continuous casting mold assembly rests, and vertical limbs which are parallel to the vertical limbs of the stationary beam, the two links being disposed directly above one another with each link being connected with a respective hinge joint to the stationary vertical beam and to the vertical limb of the respective frame. The oscillation can be effected by a drive element engaging the frame, preferably a hydraulic cylinder acting on the cantilever arm from below. The links each may comprise a rigid member or bar which can be bifurcated at its end so as to form respective slots receiving the respective leaf springs. The fixed beams may have limbs turned toward the respective frame and to the underside of which the respective leaf spring can be clamped by bolts passing through the horizontal member and the leaf spring. Advantageously, blocks may be held against the leaf springs by the bolts. Each leaf spring thus defines a respective horizontal pivot axis.

It has been found to be advantageous to form each leaf spring as a packet or stack of individual spring leaves, i.e. from a stack of individual thinner spring members.

The system of the invention has numerous advantages among which are:

Zero maintenance for pivots.

Zero wear of pivots.

Low cost fabrication of the leaf spring attachments.

Possibility of drive of the system with two hydraulic cylinders, thereby eliminating the problem of synchronizing four such cylinders.

Elimination of the need for foundation or base to support twice the load of the mold.

Elimination of the need to balance the mold and thereby adversely affect the oscillation frequency or patterns. In fact, with the system of the invention the springs/mass system has no characteristic resonance which is significant for the purposes of the invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
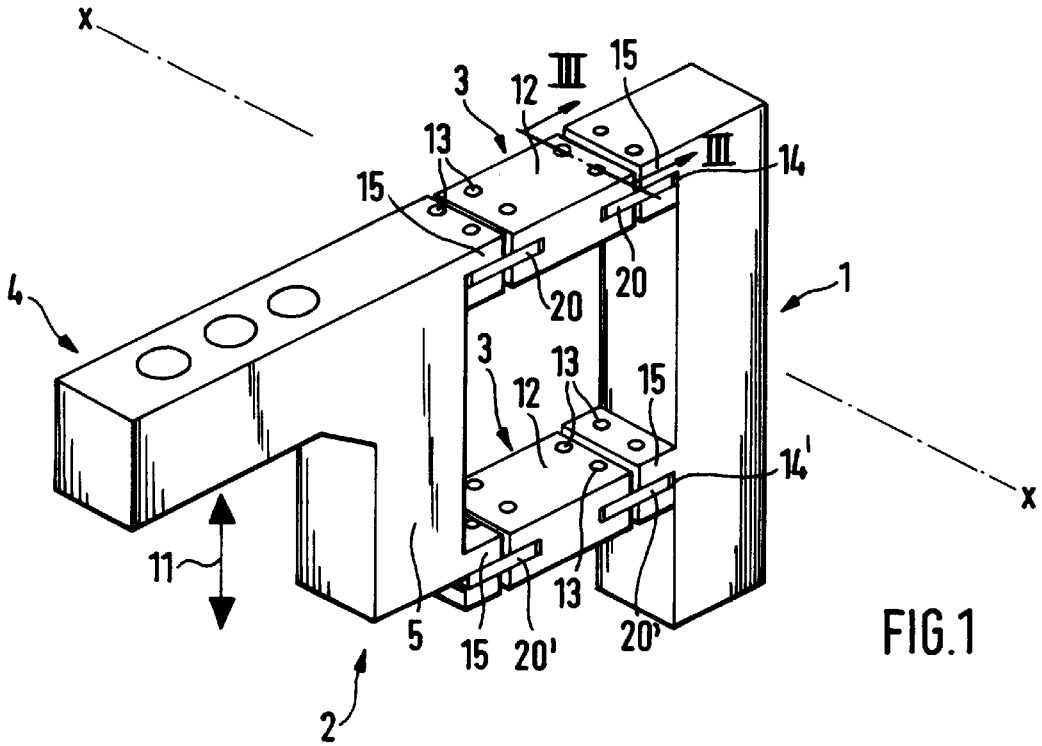
FIG. 1 is a perspective view of one of the support members of the apparatus.
Figure 2:
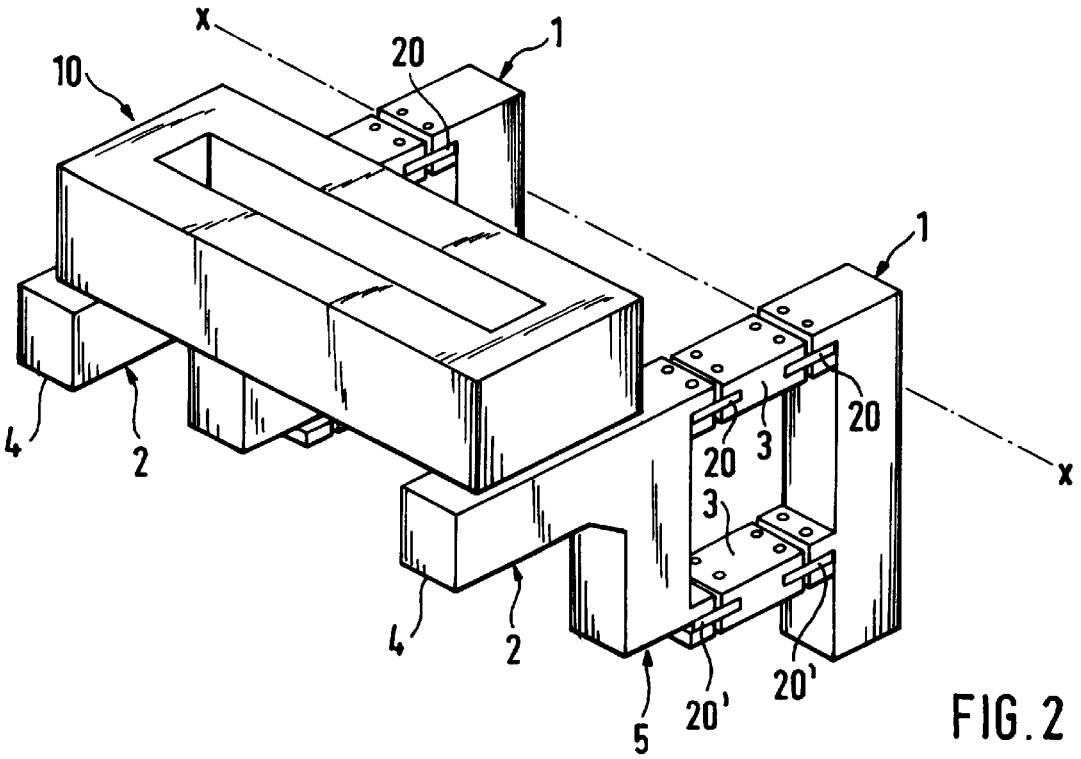
FIG. 2 is a perspective view drawn to a somewhat smaller scale than FIG. 1 and showing a mold assembly support on the support arrangement of the invention.

FIG. 1 shows one of the support structures according to the invention which can accommodate the oscillating continuous casting mold 10, the latter being an assembly as described in the aforementioned copending applications and being shown diagrammatically in FIG. 2. The continuous casting mold assembly 10 is mounted on two such support structures, each of which has a respective fixed vertical beam 1 on which a support frame 2 is mounted with a pair of horizontal links 3 located one above the other in a plane of the frame and support beam. The horizontal links 3 are articulated at one end of beam 1 and at the other end of the support frame 2. The support frame 2, in turn, comprises a vertical beam 5 and a cantilever arm 4, the latter receiving the mold assembly 10.

Between each beam 1 and the beam 5 parallel thereto of the frame 2, the horizontal links 3 extend with the hinge joints 20 interconnecting the links with these beams.

Each of the hinge joints 20 is a leaf-spring hinge and leaf-spring hinges are maintenance free and wear-free and relatively inexpensive to fabricate. The oscillating drive can be a hydraulic cylinder 11 for each of the frames 2 and in practice complex and inexpensive synchronization systems are not necessary to operate the hydraulics, it merely being advantageous to connect the hydraulic cylinders in parallel. The hydraulic cylinders 11 can engage the cantilever arms 4 from below.

The system does away with any lever mechanism doubling the load on the foundation or support and it has been found that, as a practical matter, the spring/mass-system does not have an intrinsic resonance point which must be of concern. As a consequence, a single driver 11 under each cantilever arm suffices to effect the oscillating drive.

The springs can be relatively soft, although the rigid body 3 forming the link between the leaf springs ensures a highly precise guidance of the mold assembly 10 with respect to the position thereof.

Each of the blocks 12 forming the rigid member of the links 3 is provided with a pair of slots 30 in the respective end thereof, into which a horizontal leaf spring 20 or 20' is inserted and each of the beams 1 and 5 can be formed with a horizontal ledge 31 against which the leaf spring 20 or 20' is clamped with the aid of a block 32. Alternatively, the beams can have slots into which the hinges 20 are inserted.

Each leaf spring hinge 20, 20' thus defines a horizontal oscillation axis x—x, only one of which has been shown in FIG. 2.

Advantageously the cross sections of the leaf spring hinges 20 and 20' is so selected that its geometric moment of inertia is small in the deformation direction and is large in the displacement direction. That means that the stresses which arise as a result of the movement are smaller than the permissible stresses for a reverse bending capacity. In the guiding direction the deformation resulting from the stresses generated by the displacement force is very small.

It has been found to be especially advantageous from a cost point of view to clamp the leaf spring members 20 in the slots 14 and 14' formed by the grooves 30 and between the block 32 and the overhanging portion 31, respectively. The bolts 13 have been shown in greater detail in FIGS. 3 and 4. The beams 1 and 5 may also have overhanging portions as shown at 15 to which the springs 20 and 20' are clamped.

As can be seen from FIG. 2, the two support structures are identical and are disposed in parallel planes to carry the ends of the assembly 10 on their cantilever arms 4.

Figure 3:
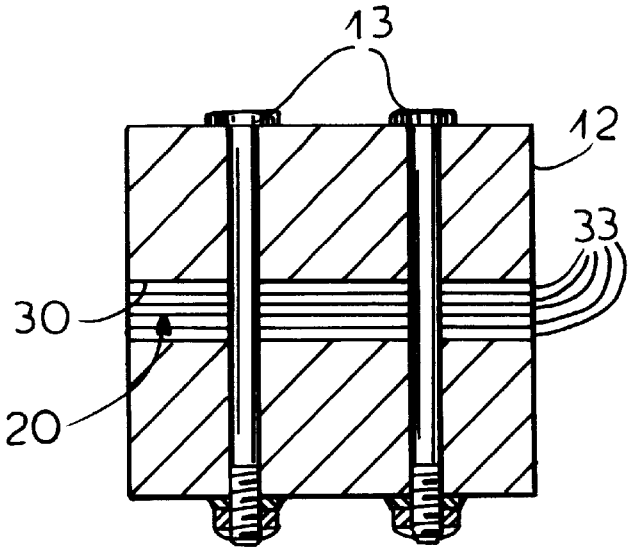
FIG. 3 is a cross sectional view taken along the line III—III of FIG. 1.
Figure 4:
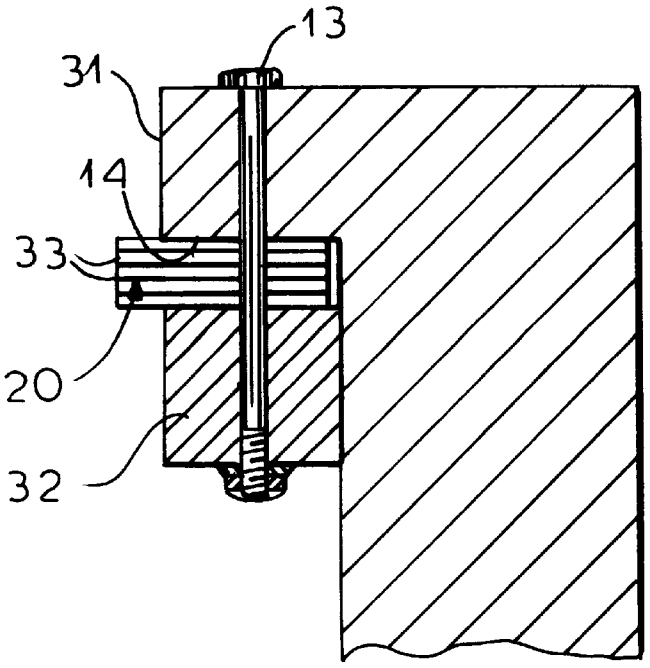
FIG. 4 is a cross sectional view in a plane perpendicular to the section line of FIG. 3 through the attachment of a leaf spring to the vertical support member.

As has been shown in FIGS. 3 and 4, each of the leaf springs 20 and 20' can be comprised of a stack of relatively thin individual leaf springs 33 e.g. of spring steel.

I claim:

1. A continuous casting assembly comprising a support structure for an oscillating continuous casting mold, said support structure, comprising:

a pair of fixed vertical support beams;

a respective support frame mounted on each of said support beams and carrying a continuous casting mold;

a pair of links located one above another between each of said frames and the respective beam;

a leaf spring mounting for connecting and supporting said frames on said beams and each consisting of leaf spring hinges between each link and the respective beam, and the respective beam resiliently supporting said continuous casting mold and said frames on said beams for oscillating movement of said mold up and down relative to said beams, each of the support frames being formed with a cantilever arm; and a drive element under each cantilever arm for oscillating the continuous casting mold on said arms.

2. The support structure defined in claim 1 wherein each of said links comprises a rigid intermediate member provided with a respective one of said leaf spring hinges at each end of said member and connected either to the respective beam.

3. The support structure defined in claim 2 wherein each of said leaf spring hinges has a horizontal oscillation axis about which the respective hinge can pivot.

4. The support structure defined in claim 3 wherein each of said leaf spring hinges is comprised of a stack of relatively thin individual leaf springs.

5. The support structure defined in claim 4 wherein a free end of each of said leaf spring hinges is clamped in a respective horizontal slot to a respective link, or beam or by at least one bolt.

6. The support structure defined in claim 5 wherein said beam has horizontally projecting formations to which the respective leaf spring is clamped.

7. The support structure defined in claim 1 wherein each of said leaf spring hinges is comprised of a stack of relatively thin individual leaf springs.

8. The support structure defined in claim 1 wherein a free end of each of said leaf spring hinges is clamped in a respective horizontal slot to a respective link, or beam by at least one bolt.

9. The support structure defined in claim 1 wherein said beam and said frame has horizontally projecting formations to which the respective leaf spring is clamped by bolts passing through the leaf spring and the respective horizontally projecting formation and engaging a block held against the leaf spring and lying parallel to the respective horizontally projecting formation.

* * * * *